United States Patent [19]

Linka

[11] Patent Number: 4,790,358

[45] Date of Patent: Dec. 13, 1988

[54] MULTI-SYSTEM WEAVING LOOM WITH PERMANENT MAGNET SHUTTLE DRIVE

[75] Inventor: Adolf Linka, Hechingen-Bechtoldsweiler, Fed. Rep. of Germany

[73] Assignee: Lindauer Dornier Gesellschaft m.b.H., Lindau/Bodensee, Fed. Rep. of Germany

[21] Appl. No.: 123,376

[22] Filed: Nov. 20, 1987

[30] Foreign Application Priority Data

May 30, 1987 [DE] Fed. Rep. of Germany ..... 3718306

[51] Int. Cl.[4] ..... D03D 47/26

[52] U.S. Cl. ..... 139/436

[58] Field of Search ..... 139/13 R, 436, 452, 139/224 R, 437

[56] References Cited

U.S. PATENT DOCUMENTS

| | | | |
|---|---|---|---|
| 2,845,093 | 7/1958 | Dietzsch et al. | 139/436 |
| 3,618,640 | 11/1971 | Linka . | |
| 3,626,990 | 12/1971 | Linka . | |
| 3,729,029 | 4/1973 | Zabrodsky et al. | 139/436 |
| 3,749,135 | 7/1973 | Linka . | |

FOREIGN PATENT DOCUMENTS

| | | |
|---|---|---|
| 83864 | 5/1955 | Czechoslovakia . |
| 3346030 | 6/1985 | Fed. Rep. of Germany . |
| 1066958 | 10/1959 | German Democratic Rep. . |
| 1287526 | 1/1969 | German Democratic Rep. . |

*Primary Examiner*—Henry S. Jaudon

*Attorney, Agent, or Firm*—Frishauf, Holtz, Goodman & Woodward

[57] ABSTRACT

To decrease noise as magnetically moved shuttles engage a guide reed (10) located behind a shed (8), while being moved by magnetic shuttle moving elements (16) to move the shuttles (9) by magnetic coupling therewith, the shuttle moving elements (16) include plungers to push the shuttles away from the shuttle moving elements after they have passed through a curved path, adhered to the shuttle moving elements, the plungers being controlled in their pushing movement by engagement with a guide or control cam (37) on which the plungers ride up as the shuttle moving elements move past the cam. Preferably, essentially wedge-shaped run-on and run-off ramps are also provided at terminal ends of the guide reed.

11 Claims, 6 Drawing Sheets

MULTI-SYSTEM WEAVING LOOM WITH PERMANENT MAGNET SHUTTLE DRIVE

Reference to related patents, the disclosure of which is hereby incorporated by reference:

U.S. Pat. No. 3,049,155
U.S. Pat. No. 3,618,640
U.S. Pat. No. 3,626,990
U.S. Pat. No. 3,749,135

Reference to related disclosures, illustrating the state of the art:

German Patent Disclosure Document DE-OS No. 33 46 030
Czechoslovakian Pat. No. 83,864
German Pat. Nos. 1,066,958; 1,963,208; 1,785,147; 1,287,526;
German Pat. No. 3,016,182.

Reference to related applications, the disclosure of which is hereby incorporated by reference, and assigned to the assignee of this application:

U.S. Ser. No. 07/146,263, filed 1-20-1988, LINKA et al;
U.S. Ser. No. 07/123,597, filed 11-20-87, LINKA;
U.S. Ser. No. 07/131,637, filed 12-11-87, LINKA et al;
U.S. Ser. No. 07/163,619, filed 3-3-1988, LINKA et al.

The present invention relates to a multi-system weaving loom in which shuttles are carried through the shed by a permanent magnet shuttle drive, the shuttles moving continuously first in an essentially straight path through the shed and then through a curved path for return or through another shed of another weaving system, so that the shuttles move in an endless path.

BACKGROUND

The path of the shuttle is guided across the width of the fabric at least over a substantial portion of the longitudinal path by a guide reed. The shuttle is guided on the guide reed and moved, by magnet coupling to magnetic shuttle moving elements which are carried along the shed, for example by an endless chain, by being coupled together, or the like.

German Pat. No. 30 16 182 describes a multi-system weaving loom built in back-to-back construction. On the front side and the back side, respectively, the shuttles pass through a straight portion of their guide path and through the shed, so that in the straight portion one or more fabric webs can be made. The shuttles are driven by drive elements which are either coupled together or coupled to an endless chain. The drive elements carry permanent magnets on the side facing the shed and the shuttle likewise carries permanent magnets which are in magnetically coupled relation to the drive element magnets. The magnetic coupling provides for moving of the shuttles, as set forth in general principle in U.S. Pat. No. 3,618,640 and German Pat. No. 1,785,147, respectively.

The two essentially straight portions of the guide path for the shuttle are coupled by curved return portions in which the shuttle leaves the shed and is guided over an essentially semi-circular path. Two sprockets are located in the region of the return path over which either the drive chain or the connected drive elements or drive segments are carried, which, upon passing through the return path, are spread out in fan-shape.

An essentially guide reed guides the shuttles in in the straight portion of the shuttle path. The shuttle path is essentially defined by the reed which forms a stable slide surface for the shuttle which is magnetically coupled to the drive segments.

The shuttles are coupled in the region of the semicircular return path by being coupled directly to the drive elements, without interposition of the guide reed or an interposed structure. The facing pole surfaces of the permanent magnets of the shuttle have a foil of plastic of highly slippery surface characteristics applied thereto; between the pole surfaces, thus, of the drive segments and of the shuttle there is only a thin slide foil interposed. This thin slide foil is provided to insure low friction sliding of the shuttle on the reed. The very tiny air gap formed between the magnets of the shuttle and the associated pole surfaces of the permanent magnets hardly detracts from the magnetic adhesive forces which, thus, in the return path are very high. This magnetic force is strong enough so that, even at substantial speed, the shuttles are not separated from the drive elements due to centrifugal force.

Before the shuttles can enter the shed in the portion adjacent the curved portion, and at the transition from the curved to the straight portion, it is necessary to guide the shuttle again on the guide reed. Upon high-speed movement of the shuttle, this leads to difficulty. A typical speed of the shuttle is about 1.4 m/sec. If adjacent shuttles are spaced from each other by, for example, 20 cm, seven shuttles will engage the reed or a run-on portion thereof each second. The continuous engagement of the shuttle with the reed causes noise and, additionally, subjects the slide surface to wear, particularly due to friction with the run-on region.

THE INVENTION

It is an object to provide for smooth and low-noise transition of the shuttles from the curved path where they are tightly magnetically coupled to the shuttle moving elements, and effectively in surface engagement therewith, to the essentially straight-line portion where they are physically separated from the drive element, while maintaining, however, the magnetic force coupling.

Briefly, a separating structure is provided separating the shuttles from the associated shuttle carriers or travelers or shuttle moving elements due to adhesion by magnetic attractive force between the shuttle moving element and the shuttle. The separating means permits passage of the shuttle over the straight guide path without impingement on the reed or a run-on portion thereof. The separating structure is carried by the shuttle moving elements and is operated in dependence on the instantaneous position of the shuttle moving elements upon approach of the shuttle, magnetically adhered to the shuttle moving element, to the guide reed, to lift the shuttle off the shuttle moving element by a distance necessary for operation of the shuttle lengthwise of the guide reed.

The shuttle separating means are controlled in dependence on movement of the shuttle moving elements to which they are coupled, for example by a cam located in the path of the separating means which, for example, can be formed as plungers, spring-loaded to be normally retracted, but engageable by the cam to push the shuttle counter the magnetic attractive force and away from the shuttle moving element, to provide for the necessary distance to place the shuttle on the guide reed.

Controlling the shuttle separating structure in dependence on movement of the drive segments to separate the shuttle from the drive segments permits gentle and low-wear engagement with the guide reed, which, then, guides the movement of the shuttle through the shed. Since the shuttles are directly lifted off their surface engagement from the shuttle moving elements, no frictional forces are applied to the shuttle or to the drive elements as such which might cause undesired wear thereof.

In accordance with a preferred feature of the invention, the separating element is controlled in a path portion in which the shuttle is already on an essentially straight path section of its guide path, that is, when no centrifugal forces occur anymore, which, otherwise, due to the high centrifugal forces might cause tearing off of the shuttles from the drive segments.

Gentle, and hence low-noise run-off of the shuttles after they have left the web is obtained by arranging a run-off ramp adjacent the guide reed, which run-off ramp, in cross section, is at least partially wedge-shaped. Similarly, a run-on ramp can be placed in advance of the guide reed which, likewise, is essentially wedge-shaped.

DRAWINGS

DETAILED DESCRIPTION

Figure 1:
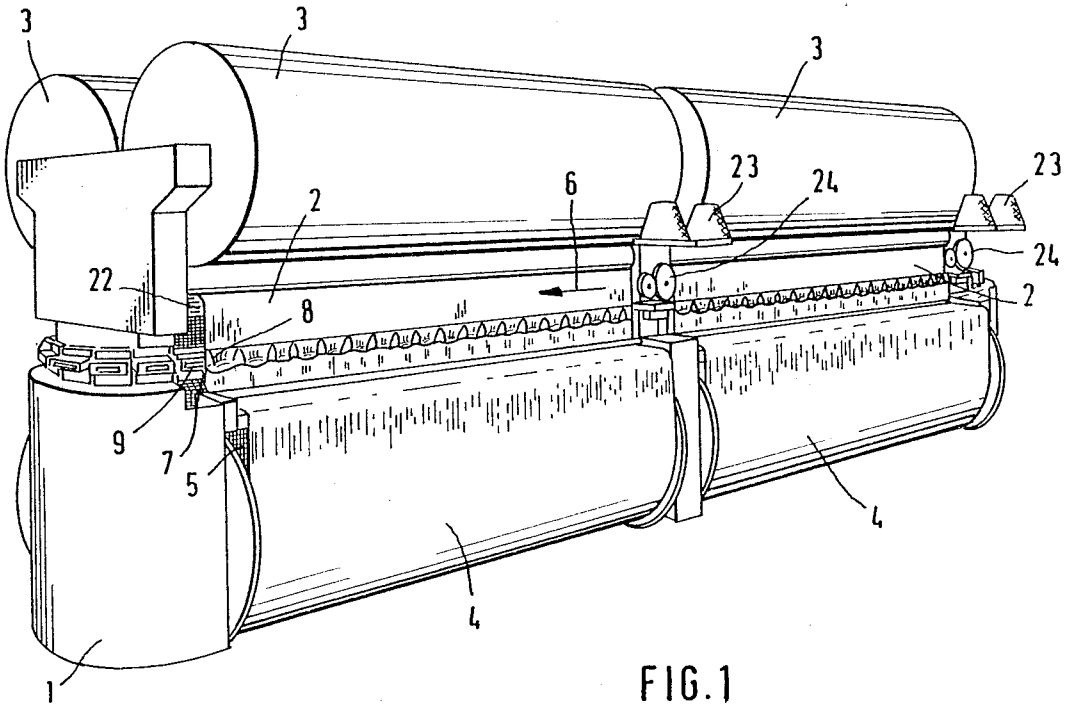
FIG. 1 is a perspective view of a multi-system weaving loom in back-to-back construction and including the subject matter of the present invention.

The multi-system weaving loom in back-to-back construction has a machine frame 1. It is constructed to permit simultaneous manufacture of four cloth webs 2. Each one of the webs 2 is rolled to a cloth roller on cloth draw-off rollers 3. The warp beams 4 are located at the bottom of the machine frame 1 from which warp threads 5 are guided over suitable guide rollers. Transversely to the warp beam 4, movable heddles 7 form sheds 8 which move the warp threads transversely to the path of the thread to form continuously progressing sheds. As the sheds are formed, with the warp threads 5 continuously changing position, a shuttle 9 is passed through the shed. The shuttles themselves are shown in detail in FIGS. 3 and 4.

Figure 2:
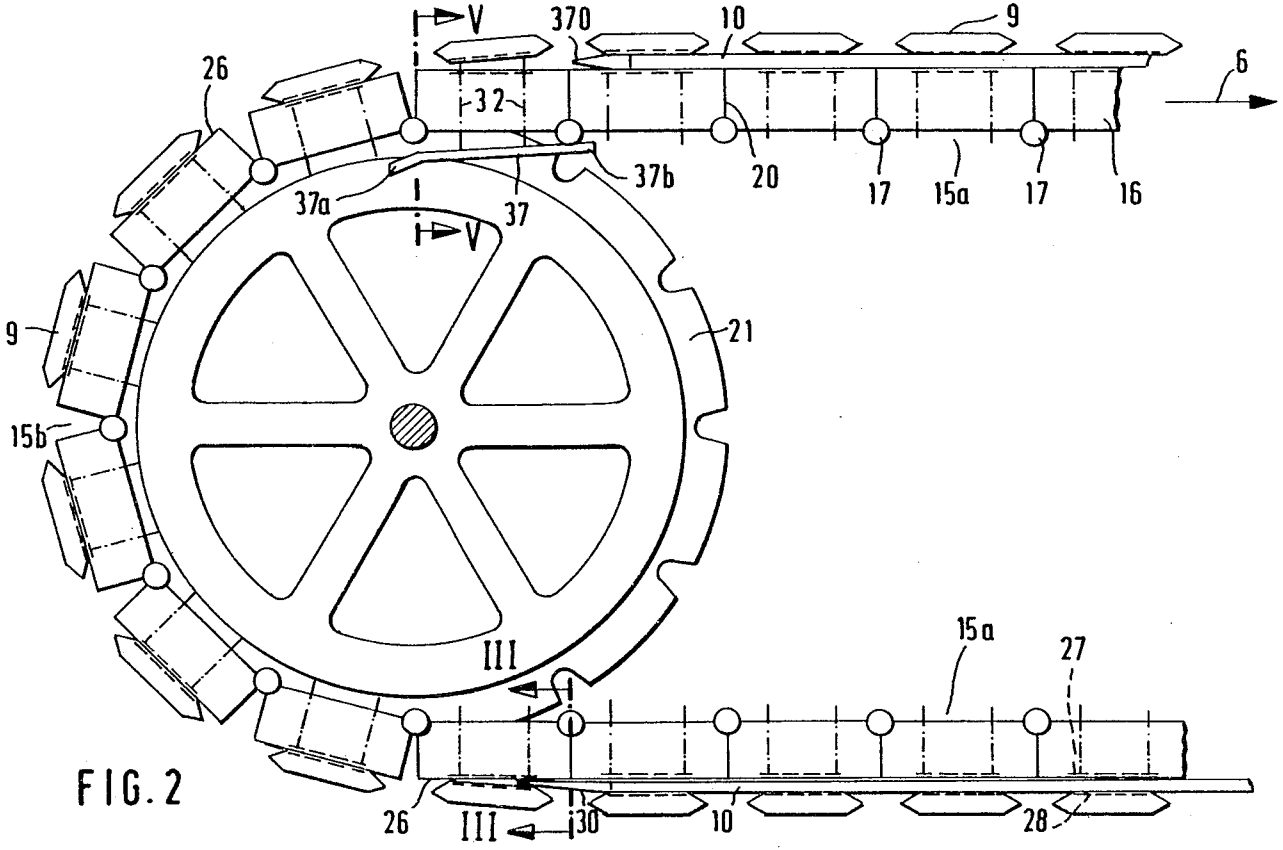
FIG. 2 is a fragmentary top view cut along line II—II of FIG. 1, and illustrating, in fragmentary representation, the bent return path of the shuttles and a portion of the shuttle path.

The shuttles 9 run, one behind the other, in predetermined spacing, as best seen in FIGS. 1 and 2, on a guide path which is formed on one side by a guide red 10. The guide path is formed on the other side by shuttle engagement lamellae 11 which are pivotably located on a bed 12, secured to the machine frame. The lamellae 11 are pivotable about a pivot point 13, for beating up of the weft thread. Lateral guidance is obtained by the reed elements of the guide reed 10 and by guide elements 14 set in the bed 12 (see FIG. 3) and spaced from each other. The mechanism which provides for movement of the lamellae 11 is not shown, since it is well known and may be constructed in accordance with any suitable arrangement. In general, it includes two rollers which move in common with the shuttles 9 and which cause tipping of the lamellae 11 about the pivot point 13.

The guide path along which the shuttle 9 operates has two straight portions (see FIG. 2) **15*a* and two adjacent semi-circular return portions 15*b*. The shuttles 9 are moved by shuttle moving elements of drive segments 16, also known as travelers, continuously and in the same direction. The drive elements are either coupled together by joints 17 (FIG. 2) or are secured, one adjacent the other, to an endless chain 18 (FIG. 4), for example by an attachment shown at 19. When the shuttles pass through the straight portions 15*a*, the shuttle moving elements 16 engage each other with their adjacent end surfaces 20, as seen in FIG. 2**; they may also be positioned spaced from each other, and parallel to each other.

The shuttle moving elements or drive elements 16 are guided in the curved path portions **15*b* over a sprocket 21, journalled in the machine frame 1 and rotatable about vertical axes. At least one of the sprockets is driven by a motor, not shown, and as well known. The shuttle drive elements 16 thus receive a moving force to move them uniformly and in continuous similar direction in accordance with the arrows 6, FIGS. 1 and 2**.

The respective drive segments 16 are guided horizontally and vertically in suitable guide tracks or guide rails, for example on guide rails 22—FIG. 1. At the bottom of the drive segments, that is, on the side facing the heddles 7, the drive segments carry control tracks, for example in the form of grooves, in which butts from the heddles 7 engage, for movement of the heddles and hence for formation of the shed, as described in detail in U.S. Pat. No. 3,749,135 and German Pat. No. 1,963,208, respectively, for example.

Before the shuttles 9 enter the shed 8 of one of the fabric webs 4, a weft thread supply device, shown schematically at 24 (FIG. 1), supplies a piece of weft thread of predetermined length from a suitable supply spool 23. Supply of weft threads to the shuttle is described, for example, in U.S. Pat. No. 3,626,990.

Each one of the drive segments 16 is formed with a flat surface 26 (FIG. 2) which faces the shuttles 9 and which extends at right angles to the end surface 20. The flat surface 26 has a plurality of permanent magnets 27 set therein. A suitable number of six permanent magnets, selected for the present example. The permanent magnets 27 are located spaced from each other, adjacent each other. Similarly, each one of the shuttles 9 has permanent magnets 28 on the side facing the guide reed 10. The pole surfaces of the magnets are covered by a slide foil 29 (FIGS. 3, 4) of highly slippery plastic material. The arrangement and the polarity of the permanent magnets 27, 28 are described in detail in U.S. Pat. No. 3,618,640 and German Patent Disclosure Document No. 17 85 147. The permanent magnets 27, 28 are so arranged that, by magnetic force interaction, the shuttles 9 are magnetically coupled to the drive elements 16. Each one of the drive elements 16 has a shuttle 9 associated therewith.

When the shuttles 9 pass through the straight-line portions **15*a* of the guide path, they are carried along by the synchronously driven drive segments 16, without physical contact with the drive elements 16 however, the shuttles being supported on the guide reed 10. The facing pole surfaces of the permanent magnets 27, 28 are spaced from each other by a distance defined by the guide reed 10**.

The guide reed 10 extends essentially along the straight-line portion 15*a* of the guide path of the shuttle 9, necessary to form the fabric 4. An essentially wedge-shaped run-off ramp 30 (FIGS. 2, 4) is joined to the guide reed 10 which guides the shuttle 9, just an advance of transition into the curved return path 15*b*, to the flat front surface 26 of the respective drive segment 16, so that the shuttles can engage directly on the drive segments 16. The gap, that is, the air gap between the respectively opposite pole surfaces of the permanent magnets 27, 28, is then formed only by the thin slide foil 29. Strong magnetic attractive forces will occur between the shuttle 9 and the surface 26 of the drive segments 16 when the shuttles 29 pass through the curved return path sections 15*b* of their guide path. They are, therefore, effectively tied to the shuttle drive elements. Even upon high-speed operation of the shuttles, centrifugal forces which occur in the return paths 15*b* are not large enough to separate the shuttles 9 from the drive segments 16.

After the shuttles 9 have passed through the curved portions 15*b*, they must, again, be placed on the guide reed 10 of the straight portion 15*a* of the guide path.

In accordance with a feature of the invention, the shuttles are separated from the shuttle guide elements 16 by a separating structure which, in accordance with a feature of the invention, includes a plurality of spaced push rods or plungers 32, extending at right angles to the surface 26 associated with the permanent magnets 27, and controlled to push the shuttles 9, magnetically adhered to the guide elements, off the surface 26 to provide for the spacing so that the shuttles can run on the guide reed 10.

The drive elements 16 are formed wit ribs 34 (FIG. 3) which have through-bores 33 therein, through which the plungers 32 are passed, arranged to slide back and forth. Each one of the plungers 32 is biassed by a return spring 35 which is so positioned that—with respect to FIG. 4—it tends to hold the plunger in the withdrawn position, that is, to bias the plunger towards the right. In this position, the left or forward end of the plunger or push element 32 is spaced from the reed 10. The withdrawn position is defined by an abutment pin 36, which engages on the associated rib 34 (see FIG. 4) and against which the spring 35 is engaged and on which it is supported.

Figure 4:
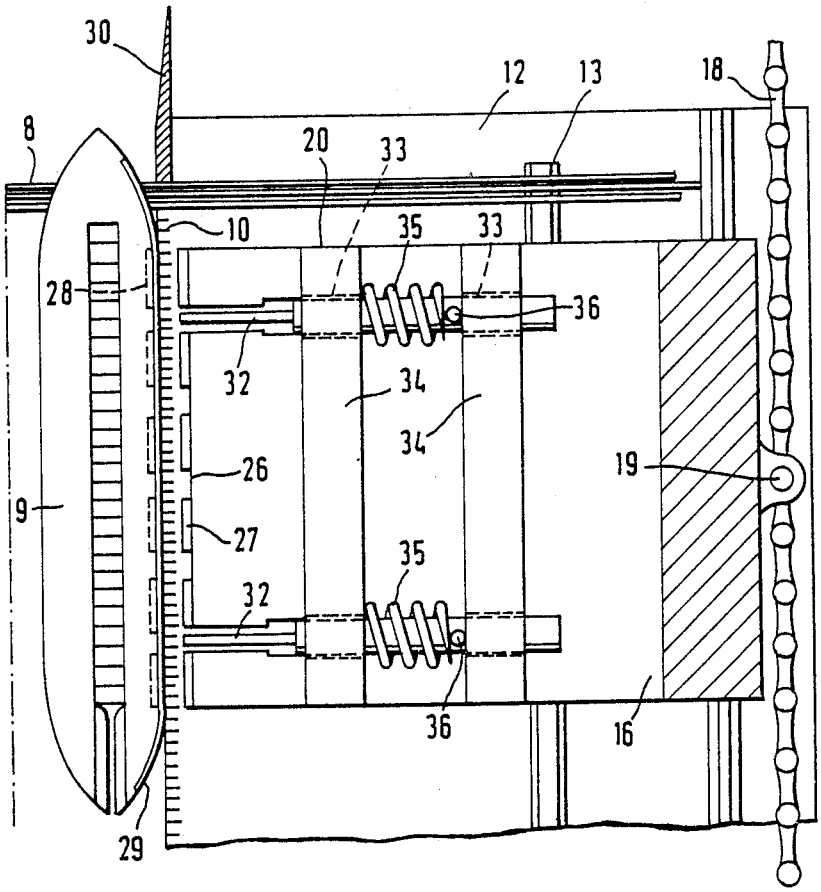
FIG. 4 is a fragmentary top view along section line IV—IV of FIG. 3.

The longitudinal spacing, that is, in FIG. 4 the spacing in vertical direction of the two plungers 32 isprefer-ably so selected that the plungers engage in the vicinity of the forward and rearward ends of the associated shuttle 9.

Figure 6:
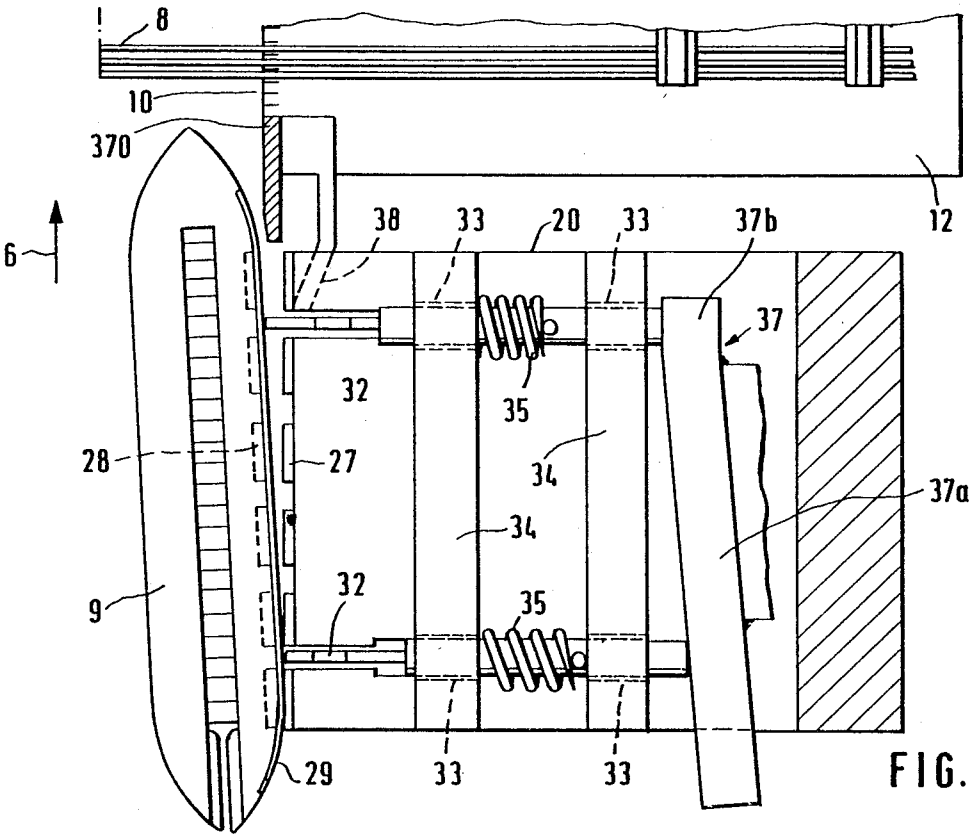
FIG. 6 is a top view taken along line VI—VI of FIG. 5.

In accordance with a feature of the invention, as best seen in FIGS. 2 and 6, the respective elements 32 are controlled in dependence on the instaneous path position of the drive segmetns 16 by a control cam 37. Cam 37 is secured to the machine frame 2 at the transition from the semi-circular guide path portion 15*b* to the straight-line guide path portion 15*a*. The control cam 37—in the direction of movement of the shuttle 9—has a portion 37*a* which is inclined with respect to the straight path of movement of the drive segments 16 in the straight portion 16, and which merges into a slightly inclined or parallel section 37*b* forming a transfer region at which the shuttle is transferred to the guide reed 10, and already lifted off from surface engagement with the drive element 16, as best seen in FIG. 6.

The control cam 37 is preferably located already on the straight-line guide path portion 15*a* so that, when it becomes effective, the shuttle 9 is no longer under the influence of centrifugal forces which arose when the shuttle passed through the curved path 15*b*.

An essentially wedge-shaped run-on ramp 370 is located just in advance of the guide reed 10 of the straight-line guide path 15*a*, see FIG. 6. The run-on ramp 370 is secured to the bed 12. The wedge-shaped portion is located counter the direction of movement—see arrow 6 in FIG. 6—of the shuttle 9. The run-on ramp is coupled to a fixed curve or cam surface 38, and extending inwardly as best seen in FIG. 6. The curve or cam surface 38 is a safety arrangement which insures that, if a return spring 35 should fail, the slider 32 would then engage the plunger 32 and forcibly push the plunger 32 into retracted position, so that it cannot engage with the run-on ramp 370 and the reed 10, and damage one or more of these components. The plunger 32 can be formed with a small engagement button or an engagement opening to engage the cam 38, if it should not have been returned by the spring 35.

OPERATION

Let it be assumed that the shuttle has passed the lower straight guide portion 15*a* of FIG. 2 in direction of the arrow 6. The shuttles 6, magnetically coupled with the drive segments 16, then pass into the respectively associated shed 8. They are guided with their guide foil 29 on the guide reed 10, which limits the guide path towards the inside, and against which they are held by the magnetic forces of the permanent magnets 27, 28.

After running out of the left fabric web 4—with respect to FIG. 1—and upon transition into the semi-circular guide path 15*b* —the respective shuttles 9 run off over the run-off ramp 30 and engage, as described above, the flat surface 26 of the associated drive elements 16, where they are held with substantial magnetic force due to the close, effectively pole-to-pole engagement with only the spacing of the thin slide foil therebetween.

Figure 3:
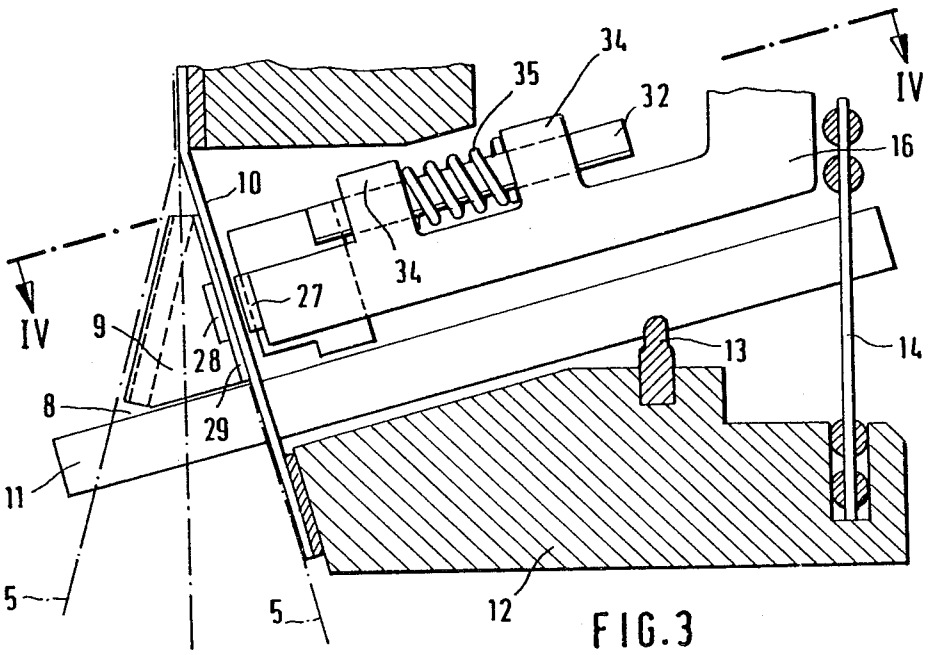
FIG. 3 is a longitudinal cross-sectional view taken along line III—III of FIG. 2 and illustrating, in fragmentary representation, a portion of the drive arrangement.

The position immediately in advance of the run-off of the respective shuttle 9 from the reed 10 is shown in FIGS. 3 and 4. The plungers or push elements or push rods 32 are returned by the springs 35 in the withdrawn position, in which they are spaced from contact with the guide reed 10.

Figure 5:
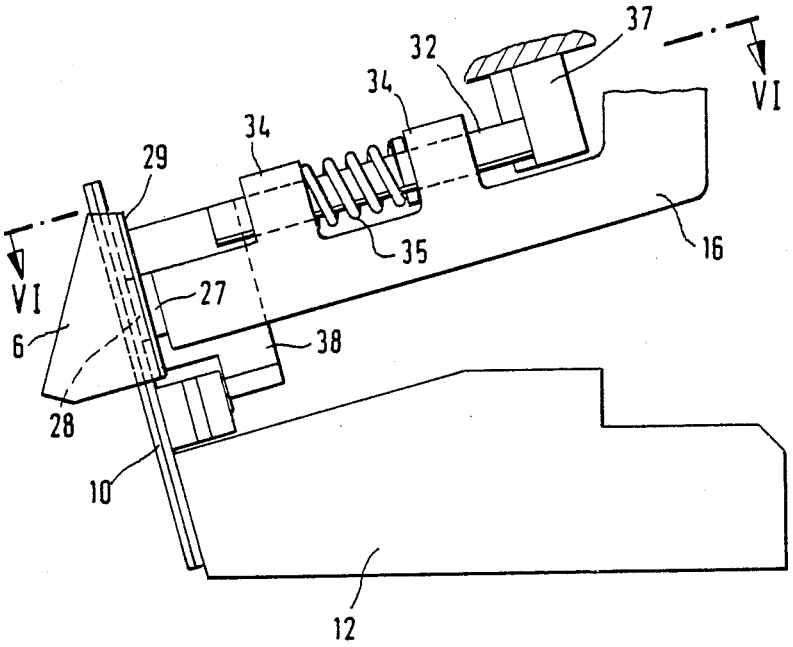
FIG. 5 is a fragmentary side view along the line V—V of FIG. 2.

After the plungers have passed through the curved guide path 15*b* (as seen in FIG. 2, upper portion), the respective guide elements 16 will reach the region of the control cam 37. This position is shown in FIGS. 5 and 6. Control cam 37, preferably, is adjustable longitudinally along the guide track, and additionally adjustable in height. As best seen in FIG. 6, the forwardly positioned push element or plunger 32 engages the more highly inclined run-on region 37*a* of the control cam 37, which lifts the shuttle 9 counter the magnetic attractive force of the permanent magnets 27, 28 from the surface 26, by gradually increasingly lifting the shuttle away from the surface 26. Eventually, and upon further movement of the shuttle, the rearward plunger 32 will also begin its lift-off movement. The shuttle, initially, is placed in an inclined position (see FIG. 6) with respect to the surface 26. This has the advantage that the lift-off force is not applied suddenly, but gradually during the forward movement of the shuttle.

The transition zone 37*b* of the control cam is so dimensioned and selected that, upon movement of the plungers or push rods 37, the shuttle 9 is spaced from the surface 26 of the drive segment 16 by a dimension that, upon further movement, it slides smoothly on the run-on ramp 370 for transition to the adjacent guide reed 10, without requiring substantial back holding forces counter its direction of movement, which might lead to shifting or tearing off of the shuttle from the drive segment 16.

Upon transition of the shuttle 9 on the reed 10, the sliders or plungers 32 run off the control cam 37, and are returned into the quiescent or rest position by the springs 35 or, in case of malfunction, by the cam surface 38.

The shuttles 9 receive a weft thread immediately in advance of the entry into the shed 8 for insertion into the shed 8 by the shuttle as it moves therethrough.

Placing a control cam in the path of the plungers 32 provides a simple and sturdy construction which, for example, by elongated holes, can be readily adjusted. The control cams, preferably, are so designed that they can be adjusted in longitudinal direction of the guide path, as well as in the height thereof. Adjustment in longitudinal direction permits control of the timing of effectiveness of the cam surface formed by the cam 37.

In accordance with a preferred feature of the invention, the cam surface first has a more highly inclined portion 37*a*, which smoothly merges into a further inclined portion 37*b*, which has only a very shallow angle of inclination, or which then is parallel to the path of the shuttle along the longitudinal path portion 15*a*. This permits relatively fast initial separation of the shuttle from the shuttle drive element 16 as it approaches the guide reed 10, while it is then placed precisely on the desired spacing to permit engagement with the guide reed 10 and maintainance thereon when it is transferred to the guide reed 10, with fine control and smooth movement, avoiding any abrupt changes in position or movement.

In accordance with a preferred feature of the invention, the plungers or push elements are located on the drive elements 16 themselves. Resilient spring biassing of the plungers is desirable, although the movement of the plungers could also be controlled by cams. An additional cam 38, for safety, is preferably provided, to prevent engagement of a still projecting plunger 32 against the reed or the run-on cam 370.

Use of two plungers, one after the other, and sequentially engaged as the shuttle moving element 16 moves, has the advantage that the magnetic coupling forces are counteracted by the mechanical force pushing the shuttle away only gradually and progressively as the shuttle moves, rather than abruptly.

Various changes and modifications may be made within the scope of the inventive concept.

I claim:

1. Multi-system weaving loom having means for forming a shed (8);

means for defining a straight shuttle guide path (15*a*) for guiding the shuttle through the shed;

means for defining a curved shuttle guide path (15*b*) merging into said straight shuttle guide path;

a guide reed (10) located adjacent said straight guide path (15*a*) outside of the shed for guiding movement of the shuttle through the shed;

a plurality of magnetic shuttle moving elements (16) located adjacent the guide paths (15*a*, 15*b*) for moving the shuttles in said guide paths;

shuttle magnetic means located on the shuttle (9) for magnetic attractive coupling with the respective magnetic shuttle moving elements; and drive means coupled to the magnetic shuttle moving elements for moving said shuttle moving elements and hence the shuttles through the shed, and comprising, in accordance with the invention, means for separating the shuttles (9) adhering to an associated shuttle moving element (19) by magnetic attractive force as the shuttle is moving through said curved guide path and adjacent the terminal ends of the guide reeds, said separating means permitting passage of the shuttle over the straight guide path, said separating means being carried by said shuttle moving elements (16) and being operated, in dependence on the instantaneous position of the shuttle moving elements upon approach of the shuttle magnetically adhered to the shuttle moving element, to the guide reed, to lift the shuttle off the shuttle moving elements by a distance necessary for operation of the shuttle lengthwise of the guide reed.

2. The loom of claim 1, wherein said separating means (32, 37) are controlled to lift the shuttle off the shuttle moving element (15*a*) when the shuttle is moving in a portion of the straight shuttle guide path (15*a*).

3. The loom of claim 1, further including an, in cross section, essentially wedge-shaped run-off ramp (30) positioned, in the direction of movement of the shuttle (9), adjacent a terminal end of the guide reed (10).

4. The loom of claim 1, further including, in the direction of movement (6) of the shuttle (9) an, in cross section, essentially wedge-shaped run-on ramp (370) located adjacent the leading terminal end of the guide reed (10).

5. The loom of claim 1, wherein the separating means (32, 37) includes a locally fixed control cam (37), and separating elements (32) engageable with the shuttle and controlled by engagement with said fixed control cam (37), said control cam being located in the path of the shuttle moving elements (16).

6. The loom of claim 5, wherein the position of the control cam (37) with respect to the guide path (15*a*) of the shuttle is adjustable.

7. The loom of claim 5, wherein the separating elements (32) include a plunger or push element (32) movably carried by each of the shuttle moving elements (16), said plunger or push element having a first end engageable laterally with a shuttle and a second end engageable with said control cam (37).

8. The loom of claim 7, wherein the control cam includes a first cam portion inclined with respect to the path of the shuttle moving elements (16) and engaging and gradually pushing said plunger or push elements (32) against the shuttle to lift the shuttle off engagement with the shuttle moving element, counter the tractive force of the magnets;

and wherein the cam includes a second portion (37*b*) of lesser degree of inclination to form a transition zone for transferring the shuttle into the region of the guide reed.

9. The loom of claim 7, further including spring means (32) coupled to the plunger or push element (32)

and biassing said plunger or push element in a direction towards the control cam (37).

10. The loom of claim 7, further including a reset cam surface (38) fixed with respect to the path of the shuttle moving elements (16) and engageable with the plunger or push element (32) to reset the plunger or push element to a retracted position clear of the shuttle as said shuttle moving elements move toward the guide reed (10).

11. The loom of claim 7, wherein two plunger or push elements (32) are provided and located on each of the shuttle moving elements (16), positioned on the shuttle moving elements staggered in the direction of movement of the shuttle moving elements, and sequentially engaging said control cam (37), for lifting the shuttle off magnetic attractive engagement against the surface of the shuttle moving element, gradually, and non-uniformly across its length as the shuttle moving element moves in a path towards the guide reed

* * * * *